US009605440B2

(12) United States Patent
Clay

(10) Patent No.: US 9,605,440 B2
(45) Date of Patent: Mar. 28, 2017

(54) MEMORIAL PHOTO BOX

(71) Applicant: Frank E. Clay, Mantua, OH (US)

(72) Inventor: Frank E. Clay, Mantua, OH (US)

( * ) Notice: Subject to any disclaimer, the term of this patent is extended or adjusted under 35 U.S.C. 154(b) by 0 days.

(21) Appl. No.: 14/934,283

(22) Filed: Nov. 6, 2015

(65) Prior Publication Data

US 2016/0130835 A1 May 12, 2016

Related U.S. Application Data

(60) Provisional application No. 62/075,974, filed on Nov. 6, 2014.

(51) Int. Cl.

| | |
|---|---|
| ***G09F 13/04*** | (2006.01) |
| ***E04H 13/00*** | (2006.01) |
| ***A47G 1/06*** | (2006.01) |

(52) U.S. Cl.

CPC ..... *E04H 13/003* (2013.01); *A47G 1/0622* (2013.01)

(58) Field of Classification Search

CPC . G09F 13/04; G09F 9/33; G09F 13/08; G09F 15/0012; G09F 13/00; G09F 19/212; G09F 13/10; G09F 15/0018; G09F 13/0413; G09F 13/14; G09F 13/0409; G09F 1/12; E04H 13/033

USPC ..... 40/716, 124.5, 721, 722, 724, 753

See application file for complete search history.

(56) References Cited

U.S. PATENT DOCUMENTS

| | | | | | |
|---|---|---|---|---|---|
| 2,247,545 | A | * | 7/1941 | Deck | G09F 27/00 40/219 |
| 4,182,061 | A | * | 1/1980 | English | G09F 1/12 40/722 |
| 4,432,152 | A | * | 2/1984 | Daenen | A47G 1/065 40/762 |
| 4,679,341 | A | * | 7/1987 | Goldman | G09F 7/10 40/490 |
| 5,018,291 | A | * | 5/1991 | Pasquale | G09F 1/12 40/584 |
| 5,595,029 | A | * | 1/1997 | Revoir | E04H 13/003 40/124.5 |
| 5,615,501 | A | * | 4/1997 | Rice | G09F 13/04 40/205 |
| 5,664,352 | A | * | 9/1997 | Beckman | G09F 13/26 40/545 |
| 5,787,625 | A | * | 8/1998 | Yesbick | G09F 15/0006 40/124.5 |
| 5,943,801 | A | * | 8/1999 | Wilkinson | G09F 13/04 40/564 |

(Continued)

*Primary Examiner* — Shin Kim
(74) *Attorney, Agent, or Firm* — Howard M. Cohn; Daniel M. Cohn

(57) ABSTRACT

A memorial photo box including a rear housing having a rear wall, upper and lower walls and side walls and a front opening defined by the upper and lower walls and the first and second side walls. The memorial photo box includes a top cover having upper and lower walls and side walls and a lip formed about a front opening defined by the upper and lower walls and the sidewalls, whereby the top cover is mounted onto the rear housing. A high resolution photo and protective UV sheeting is disposed between the lip and the front opening of the rear housing. The rear housing contains one or more strands of light bulbs and circuitry to provide power and operate the one or more strands of light bulbs. The high resolution photo disposed between the lip is illuminated by the one or more strands of light bulbs.

20 Claims, 4 Drawing Sheets

(56) References Cited

U.S. PATENT DOCUMENTS

| | | | | |
|---|---|---|---|---|
| 5,950,288 | A * | 9/1999 | Bach Lahor | A61G 17/08 27/1 |
| 6,557,284 | B2 * | 5/2003 | Nolan | G09F 13/04 40/574 |
| 6,792,710 | B2 * | 9/2004 | Whitlow | A47G 1/06 40/768 |
| 7,191,499 | B2 * | 3/2007 | Davis | A61G 17/08 27/1 |
| 7,562,423 | B2 * | 7/2009 | Pryd-Kakuk | A61G 17/08 27/1 |
| 7,813,002 | B2 * | 10/2010 | Schori | B41J 3/60 347/101 |
| 7,853,414 | B2 * | 12/2010 | Mischel, Jr. | G09F 9/00 348/826 |
| 9,074,387 | B2 * | 7/2015 | Camp, Jr. | E04H 13/003 |
| 9,175,495 | B1 * | 11/2015 | Bruyn | E04H 13/003 |
| 2005/0022436 | A1 * | 2/2005 | Lehmkuhl | G09F 19/12 40/427 |
| 2006/0236326 | A1 * | 10/2006 | Aguirre | G06F 1/1626 719/322 |
| 2011/0265361 | A1 * | 11/2011 | Frey | G09F 15/0012 40/603 |
| 2011/0307309 | A1 * | 12/2011 | Forster | G06Q 30/02 705/14.4 |
| 2013/0276337 | A1 * | 10/2013 | Gorham, Jr. | A47G 1/0616 40/124.5 |
| 2015/0201763 | A1 * | 7/2015 | Choi | G09F 13/0413 40/716 |
| 2016/0130835 | A1 * | 5/2016 | Clay | A47G 1/0622 40/124.5 |

* cited by examiner

MEMORIAL PHOTO BOX

CROSS-REFERENCE TO RELATED APPLICATIONS

This application claims the benefit of U.S. Provisional Patent Application No. 62/075,974 filed on Nov. 6, 2014 which is incorporated herein by reference.

TECHNICAL FIELD OF THE INVENTION

The present invention relates to a memorial photo box and more particularly to a backlit high resolution photo to a viewer of the grave marker.

BACKGROUND OF THE INVENTION

The use of cemetery grave markers, tombstones and similar cemetery memorials to adorn and mark gravesites is well known. These cemetery memorials can include elaborate crypts, sculptures and other similar adornments. More recently, these cemetery memorials have become substantial more subtle and tasteful, often comprising a simple slab of marble having an inscription, placed horizontally on a grave site.

Information displayed on gravestones has remained static and minimal for centuries. Name, birth date, date of death are the limited legacy most people leave behind for their time on earth. Recently, people have begun personalizing their gravestones with near photographic quality images of their homes, cars, portraits, etc. etched directly into the granite gravestone. Small plaques with swinging covers revealing photographs of the deceased have also begun to appear. In the age of a highly fragmented, diverse, and overly-mobile population, this attention to highly individualized grave markers can be attributed to a desire to enhance one's sense of immortality in the context that they are likely not being buried in the traditional small town family cemetery plot where everyone knew them.

These and other objects and advantages of the invention will become apparent from the following description and from the accompanying drawings which illustrate one embodiment of the invention.

SUMMARY OF THE INVENTION

According to an embodiment of the present invention, there is disclosed a memorial photo box to provide a backlit high resolution photo to a viewer of a grave marker. The memorial photo box includes a rear housing having a rear wall, upper and lower walls and first and second side walls and a front opening defined by the upper and lower walls and the first and second side walls. The memorial photo box further includes a top cover having upper and lower walls and first and second side walls and a lip formed about a front opening defined by the upper and lower walls and the first and second side walls, whereby the top cover is mounted onto the rear housing. A high resolution photo and protective UV sheeting is disposed between the lip formed about the front opening of the top cover and the front opening of the rear housing. The rear housing contains one or more strands of light bulbs and circuitry to provide power and operate the one or more strands of light bulbs. The high resolution photo disposed between the lip formed about the front opening of the top cover and the front opening of the rear housing is to be illuminated by the one or more strands of light bulbs.

According to another embodiment of the present invention, there is disclosed a method of providing a backlit high resolution photo to a viewer of a grave marker. The method includes providing a rear housing having a rear wall, upper and lower walls and first and second side walls and a front opening defined by the upper and lower walls and the first and second side walls. The method further includes providing a top cover having upper and lower walls and first and second side walls and a lip formed about a front opening defined by the upper and lower walls and the first and second side walls, and mounting the top cover onto the rear housing. Further, disposing a high resolution photo and protective UV sheeting between the lip formed about the front opening of the top cover and the front opening of the rear housing. The method includes disposing one or more strands of light bulbs and circuitry within the rear housing, and providing power and operating the one or more strands of light bulb. The method includes illuminating the high resolution photo disposed between the lip formed about the front opening of the top cover and the front opening of the rear housing.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

DETAILED DESCRIPTION OF THE PREFERRED EMBODIMENTS

Figure 1:
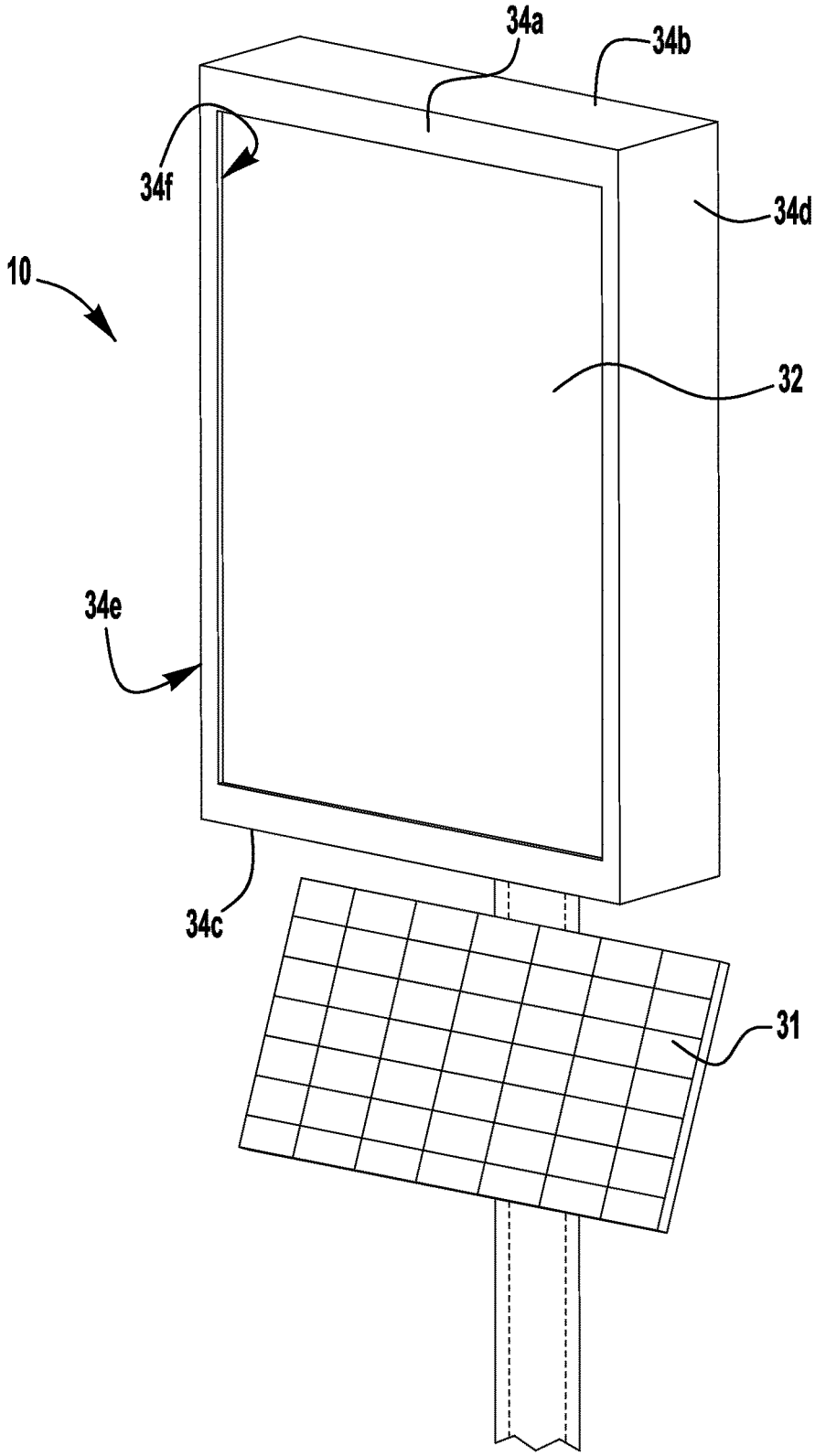
FIG. 1 is a front three dimensional view of the memorial photo box, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

Although cemetery markers generally display the name and vital statistics of the individual involved, it is often desired that the deceased's photograph or other pictorial representation be included on the grave marker. The use of picture frames, lockets, display cases and the like on headstones and other cemetery display units to display and protect memorabilia has been known for many years. While these various items can generally display and protect those items felt worthy of such display and preservation, there are shortcomings of each with regard to use on headstones and other cemetery display units.

The memorial photo box 10, as shown in FIG. 1, is designed as a memorial to remind the bereaved of a loved one and provides a tribute to the decedent. The memorial photo box 10 provides a backlit high resolution photo to a viewer of the grave marker. This access afforded by the memorial photo box 10 provides solace to the bereaved. Moreover, owners of deceased pets can beneficially employ the memorial photo box 10 as a memorial.

Figure 2A:
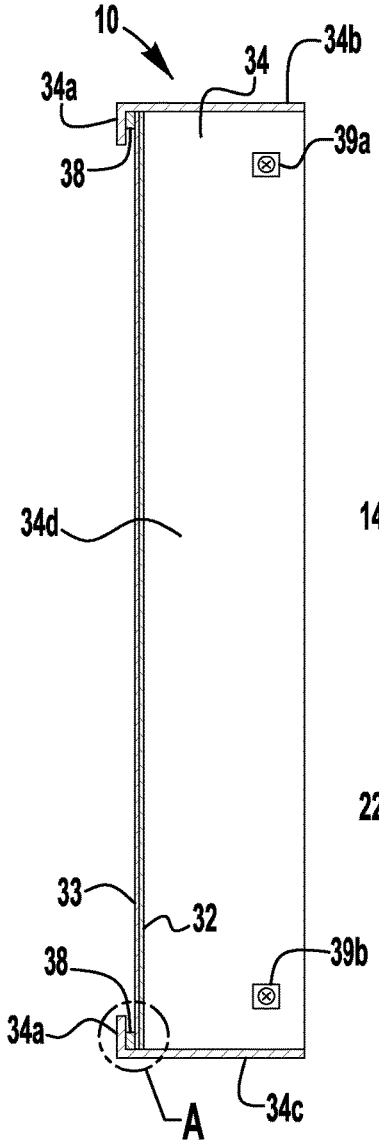
FIG. 2A is an exploded cross sectional view of portion A of FIG. 2 showing, a rubber gasket the edge of the walls of the housing, in accordance with the present invention.
Figure 2A:
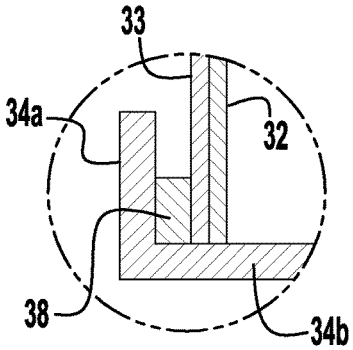
Figure 2:
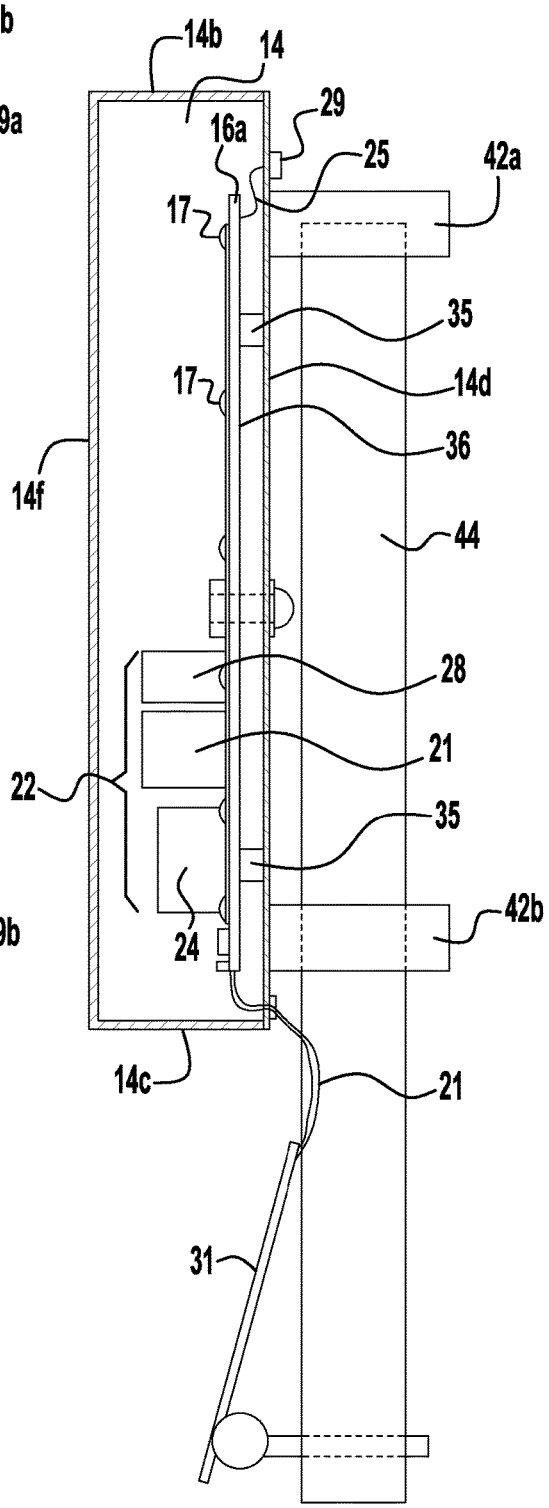
FIG. 2 is a side, cutaway view of the memorial photo box, in accordance with the present invention.
Figure 3:
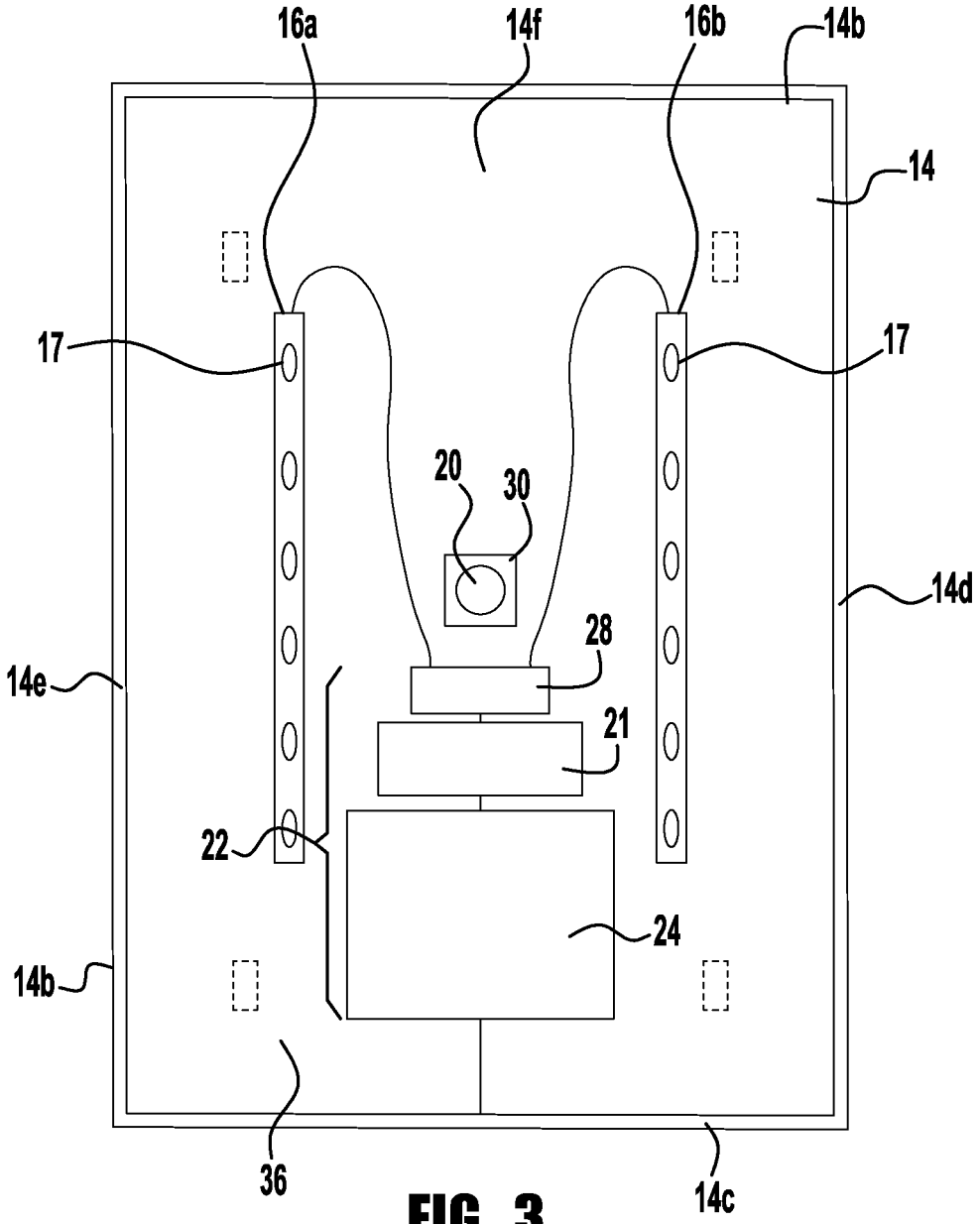
FIG. 3 is a front view of the housing component of the memorial photo box, in accordance with the present invention.

FIG. 2 illustrates a side, cutaway view of the memorial photo box 10. The memorial photo box 10 employs a generally rectangular rear housing 14 including a rear wall 14*a*, upper and lower walls 14*b* and 14*c* and first and second side walls 14*d* and 14*e*. The rear housing 14 includes a front opening 14*f* defined by the upper and lower walls 14*b* and 14*c* and side walls 14*d* and 14*e*. The rectangular rear housing 14 may be of any desired and appropriate dimensions, with exemplary dimensions of 8.5" in height, 6.5" in width, and about 2" in depth. As seen in FIG. 3, rear housing 14 secures the primary components of the memorial photo box 10, including the two strands 16*a* and 16*b* of LED light bulbs 17, a battery 20 within a battery box 30, and the circuitry 22, including the power unit 24, control unit 26, and illumination unit 28.

As seen in FIGS. 1, 2 and 2A, a top cover 34 includes upper and lower walls 34*b* and 34*c* and side walls 34*d* and 34*e*. A rectangular lip 34*a* is formed about a front opening 34*f* defined by the upper and lower walls 34*b* and 34*c* and first and second side walls 34*d* and 34*e*. The high resolution photo 32 of the decedent lies under the lip 34*a* of the top cover 34. As seen in FIGS. 1, 2 and 2A, top cover 34 is slightly wider and longer than the housing 14, which allows the upper and lower walls 34*b* and 34*c* and first and second side walls 34*d* and 34*e* to mount onto the upper and lower walls 14*b* and 14*c* and first and second side walls 14*d* and 14*e* of the rear housing 14, respectively. The dimensions of the upper and lower walls 34*b* and 34*c* and side walls 34*d* and 34*e* are such that the top cover 34 slides onto the rear housing 14 while maintaining a secure fit, and may be secured in placed with screws 39*a* and 39*b*. As shown in FIG. 2A, a rubber gasket 38 is secured under the edge of the lip 34*a* of the top cover 34 to prevent moisture from entering the housing 14, and securing the high resolution photo 32 in place.

As seen in FIGS. 1, 2, and 2A, a high resolution photo 32 of the decedent, preferably printed on white dispersion sheet, lies under a protective UV sheeting 33. The high resolution photo 32 and protective UV sheeting 33 are disposed beneath the lip 34*a* about the front surface of the top cover 34, and firmly against the gasket 38. When the top cover 34 is mounted upon the rear housing 14, the high resolution photo 32 and the protective UV sheeting 33 are secured within photo box 10.

As seen in FIG. 3, there are two strands 16*a* and 16*b* of LED light bulbs 17, which are typically approximately 2"-4" in length, each with an appropriate amount of LED light bulbs, such as 6 bulbs. Each of the strands 16*a* and 16*b* are suspended to a mounting plate or panel 36 which is connected to the rear wall 14*a* of the housing 14, using any desired method, such as adhesive or screws. One or more spacers 35 are disposed between the mounting plate 36 and the rear wall 14*a* to allow room for small nuts and bolts. When the two strands 16*a* and 16*b* of LED light bulbs 17 are illuminated, they light up the high resolution photo 32, primarily for nighttime operation.

The two strands 16*a* and 16*b* of LED light bulbs 17 may be powered with a conventional electric source such as a battery 20 or solar energy panel 31, as seen in FIGS. 1 and 2. A combination of the battery 20 and solar energy panel 31 may be incorporated with the battery 20 storing solar energy from the solar energy panel, or alternatively, the solar energy panel acting as a back-up power system. To charge the battery 20, the solar panel 31 is connected with power wire 24 the battery.

Solar power can provide electricity even at gravesites removed from the power grid. A self-contained solar energy panel 31 is a preferred way to charge an associated battery to power the strands 16*a* and 16*b*. Extending the public power grid through a cemetery is to be avoided in most situations. Further, cemeteries have a continuing need to dig new graves; and the presence of underground electric power lines would lead to needless accidents.

The electronic circuitry 22, which ultimately provides the power to the memorial photo box 10 includes the power unit 24, control unit 26, and illumination unit 28, as seen in FIGS. 2 and 3. The circuitry 22 is designed to operate at maximum efficiency. The circuitry 22, including the power unit 24, control unit 26, and illumination unit 28, are all secured to the mounting plate or panel 36, typically on a circuit board, using any desired method, such as adhesive or screws.

The power unit 24 consists of an array of different components, and supplies all the energy for the components, as well as the two strands 16*a* and 16*b* of LED light bulbs 17. Power unit 24 consists of semiconductors, diodes, the solar panel 31, rectifier diodes, battery voltage detectors, resistors, and the photovoltaic cell. The battery 20 is also included within the power unit 24.

The control unit 26 has the function of coupling or uncoupling the power unit 24 to the illumination unit 28. Further, the control unit 26 senses the amount of illumination and when the darkness threshold is met, it will couple or uncouple the power unit 24 from the illumination unit 28. The control unit 26 consists of a photocell, resistors, a capacitor, transistors, and semi-conductors.

The illumination unit 28 consists the high resolution photo 32, the two strands 16*a* and 16*b* of LED light bulbs 17, semi-conductors, and resistors.

There is a photocell 29, also called a dusk/dawn sensor, as shown in FIG. 2, that regulates the power to drive the two strands 16*a* and 16*b* of LED light bulbs 17 and can be connected thereto with a wire 25. The photocell 29 is used as a switch triggered by a change in the light striking it. After a determined amount of darkness is reached, the photocell 29 activates the memorial photo box 10 and the LED light bulbs 17 are illuminated.

The memorial photo box 10 may be mounted in any appropriate and desired manner. As seen in FIG. 2, an upper and lower bracket 42*a* and 42*b*, respectively, are mounted to the housing 14, such as by welding. These brackets can be secured to a mounting pole 44, such as a ¾" gas pipe. As seen in FIG. 2, the solar panel 31 can also be attached to the pipe 44.

Figure 4:
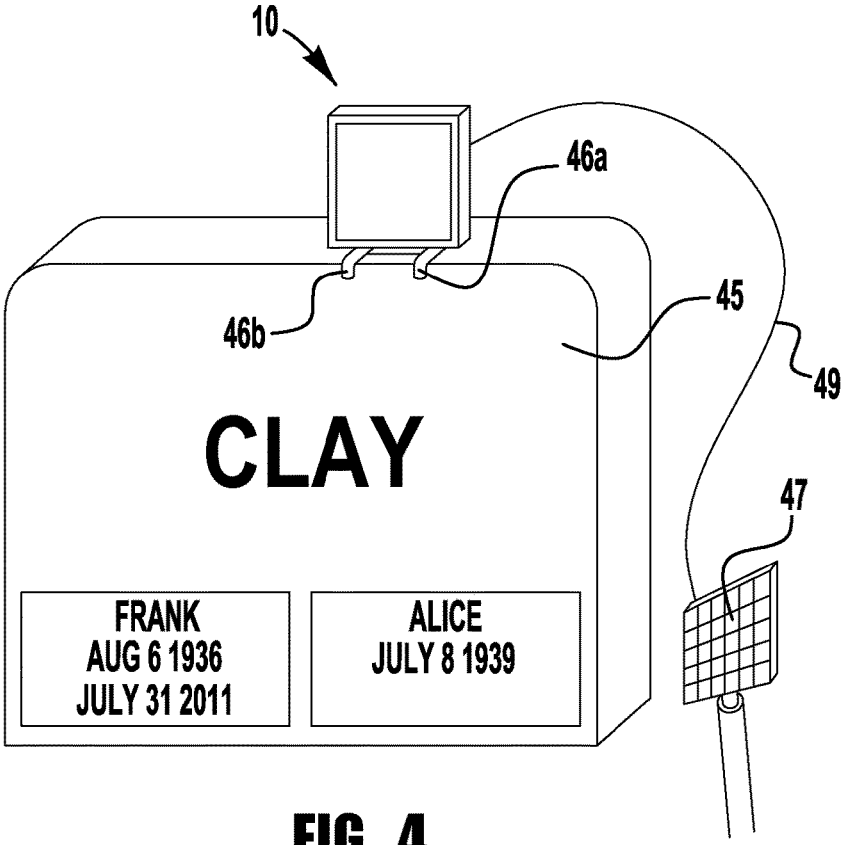
FIG. 4 is a front view of a second embodiment of the memorial photo box, in accordance with the present invention.

FIG. 4 is an alternative embodiment in which first and second mounting brackets 46*a* and 46*b* are attached to the lower wall 34*c* of the top cover 34 and mounted to the top of the grave marker 45. The solar panel 47 is externally mounted, but still connected to the battery 20 with line 49, as discussed above.

Figure 5A:
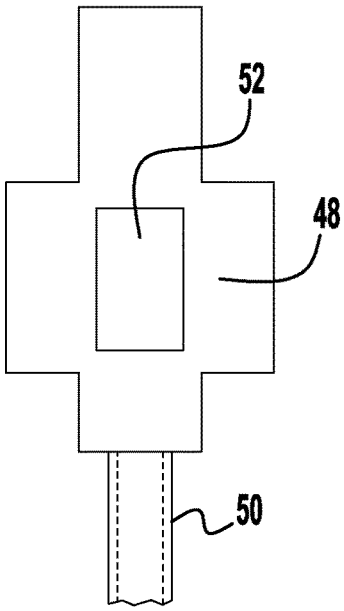
FIG. 5A is a front view of a third embodiment of a memorial photo box, in accordance with the present invention.
Figure 5B:
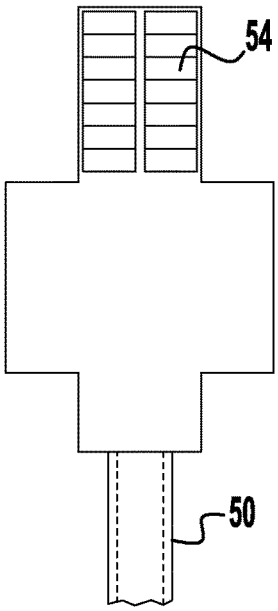
FIG. 5B is a rear view of the third embodiment of the memorial photo box shown in FIG. 5A, in accordance with the present invention.

FIGS. 5A and 5B are front and rear views, respectively, of an alternative embodiment for a cross style, stand alone memorial photo box 48, in which the stand alone photo box 48 can be secured to a pipe 50, such as a ¾" gas pipe. A high resolution photo 52 can be mounted flush and in the center of the photo box 48 and the electronic components are disposed behind the high resolution photo 52. A solar panel 54 can be mounted to the rear of the cross style photo box 48.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A memorial photo box to provide a backlit high resolution photo to a viewer of a grave marker, comprising:

a rear housing having a rear wall, upper and lower walls and first and second side walls and a front opening defined by the upper and lower walls and the first and second side walls;

a top cover having upper and lower walls and first and second side walls and a lip formed about a front opening defined by the upper and lower walls and the first and second side walls;

the top cover mounted onto the rear housing;

a high resolution photo and protective UV sheeting disposed between the lip formed about the front opening of the top cover and the front opening of the rear housing;

the rear housing containing one or more strands of light bulbs and circuitry to provide power and operate the one or more strands of light bulbs; and the high resolution photo disposed between the lip formed about the front opening of the top cover and the front opening of the rear housing to be illuminated by the one or more strands of light bulbs.

2. The memorial photo box of claim 1 wherein the strands of light bulbs are suspended from a mounting plate which is connected to the rear wall of the rear housing.

3. The memorial photo box of claim 2 wherein one or more spacers are disposed between the mounting plate and the rear wall to allow ease of connecting the mounting plate to the rear wall.

4. The memorial photo box of claim 2 wherein the strands of light bulbs are powered by a battery and the circuitry disposed within the rear housing.

5. The memorial photo box of claim 2 wherein the battery disposed within the rear housing is powered by a solar energy panel.

6. The memorial photo box of claim 4 wherein the circuitry includes a power unit, a control unit, and an illumination unit.

7. The memorial photo box of claim 6 wherein the circuitry including the power unit, the control unit, and the illumination unit are all secured to the mounting plate which is connected to the rear wall of the rear housing.

8. The memorial photo box of claim 7 wherein the power unit consists of semiconductors, diodes, the solar panel, rectifier diodes, battery voltage detectors, resistors, and a photovoltaic cell.

9. The memorial photo box of claim 8 wherein the control unit, which couples and uncouples the power unit to the illumination unit, consists of a photocell, resistors, a capacitor, transistors, and semi-conductors.

10. The memorial photo box of claim 9 wherein the illumination unit consists of two strands of LED light bulbs, semi-conductors, and resistors.

11. The memorial photo box of claim 1 further including a photocell to regulate the power to drive the two strands of LED light bulbs and as a switch to direct power to the two strands of LED light bulbs depending on the amount of light striking the photocell.

12. The memorial photo box of claim 11 wherein a rubber gasket is secured between the lip formed about a front opening defined by the upper and lower walls and the first and second side walls of the top cover and the high resolution photo.

13. The memorial photo box of claim 12 wherein an upper and lower bracket mounted to the rear housing, and secured to a mounting pole.

14. The memorial photo box of claim 12 wherein first and second mounting brackets are attached to the lower wall of the top cover 34 and mounted to the top of the grave marker.

15. A method of providing a backlit high resolution photo to a viewer of a grave marker, comprising:

providing a rear housing having a rear wall, upper and lower walls and first and second side walls and a front opening defined by the upper and lower walls and the first and second side walls;

providing a top cover having upper and lower walls and first and second side walls and a lip formed about a front opening defined by the upper and lower walls and the first and second side walls;

mounting the top cover onto the rear housing;

disposing a high resolution photo and protective UV sheeting between the lip formed about the front opening of the top cover and the front opening of the rear housing;

disposing one or more strands of light bulbs and circuitry within the rear housing;

providing power and operating the one or more strands of light bulbs; and illuminating the high resolution photo disposed between the lip formed about the front opening of the top cover and the front opening of the rear housing.

16. The method of claim 15 including suspending the strands of light bulbs from a mounting plate is connected to the rear wall of the rear housing.

17. The method of claim 16 further including powering the strands of light bulbs by a battery and the circuitry disposed within the rear housing.

18. The method of claim 16 further including charging the battery disposed within the rear housing by a solar energy panel.

19. The method of claim 16 further including regulating the power to drive the two strands of LED light bulbs with a photocell.

20. The method of claim 19 further including directing power to the two strands of LED light bulbs depending on the amount of light striking the photocell.

* * * * *